US008382363B1

(12) United States Patent
Saha et al.

(10) Patent No.: US 8,382,363 B1
(45) **Date of Patent: *Feb. 26, 2013**

(54) AUTOMATED BONE CEMENT MIXER

(76) Inventors: Subrata Saha, Brooklyn, NY (US); Pamela Saha, Brooklyn, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/295,117

(22) Filed: Nov. 14, 2011

Related U.S. Application Data

(62) Division of application No. 11/513,713, filed on Aug. 31, 2006, now Pat. No. 8,057,090.

(60) Provisional application No. 60/712,422, filed on Aug. 31, 2005.

(51) Int. Cl.
*B01F 11/00* (2006.01)
*B01F 13/00* (2006.01)

(52) U.S. Cl. ..... 366/114; 366/127; 366/139; 366/189; 366/190

(58) Field of Classification Search ..... 366/139, 366/127, 114, 189, 190
See application file for complete search history.

(56) References Cited

U.S. PATENT DOCUMENTS 3,058,014 A * 10/1962 Camp ..... 310/325
3,113,761 A * 12/1963 Platzman ..... 366/115
3,117,768 A * 1/1964 Carlin ..... 366/114
3,145,312 A * 8/1964 McAuley ..... 310/26
3,413,595 A * 11/1968 Babikov et al. ..... 367/13
3,494,359 A * 2/1970 Zackheim ..... 604/90
3,591,862 A * 7/1971 Winston ..... 310/322
3,735,159 A * 5/1973 Murry ..... 310/325
3,814,387 A * 6/1974 Ahrens et al. ..... 366/160.1
4,463,708 A * 8/1984 Gerry ..... 123/25 E
4,463,875 A * 8/1984 Tepic ..... 222/82
4,527,901 A * 7/1985 Cook ..... 366/127
4,787,751 A * 11/1988 Bakels ..... 366/110
5,121,990 A * 6/1992 Guiet et al. ..... 366/139
5,370,221 A * 12/1994 Magnusson et al. ..... 206/221
5,466,722 A * 11/1995 Stoffer et al. ..... 522/51
6,075,310 A * 6/2000 Bishop ..... 310/328
6,101,880 A * 8/2000 Face et al. ..... 73/579
6,116,773 A * 9/2000 Murray ..... 366/139
6,149,655 A * 11/2000 Constantz et al. ..... 606/94
6,494,611 B2 * 12/2002 Edwards et al. ..... 366/209
6,602,229 B2 * 8/2003 Coss ..... 604/187
6,626,912 B2 * 9/2003 Speitling ..... 606/92
7,083,322 B2 * 8/2006 Moore et al. ..... 366/118
8,057,090 B1 * 11/2011 Saha et al. ..... 366/114
2004/0151059 A1 * 8/2004 Roberts, II et al. ..... 366/112
2005/0070914 A1 * 3/2005 Constantz et al. ..... 606/92
2006/0019379 A1 * 1/2006 Taylor et al. ..... 435/306.1
2006/0089655 A1 * 4/2006 Watkins et al. ..... 606/92
2006/0100636 A1 * 5/2006 Yetkinler et al. ..... 606/92
2007/0299453 A1 * 12/2007 Constantz et al. ..... 606/92
2008/0154229 A1 * 6/2008 Lambert ..... 604/500
2008/0200916 A1 * 8/2008 Murphy ..... 606/94
2011/0251600 A1 * 10/2011 Giersch et al. ..... 606/2

FOREIGN PATENT DOCUMENTS

WO WO 9004953 A1 * 5/1990

* cited by examiner

*Primary Examiner* — Tony G Soohoo
(74) *Attorney, Agent, or Firm* — James Creighton Wray

(57) ABSTRACT

A device and related method for mixing a powdered component and a liquid component with minimal user interaction are described. A powdered component and a liquid component are separately fed into a mixing chamber. The powdered component may be released into the liquid component by removing a barrier. Alternatively, the two components are drawn into the mixing chamber from respective sources by a vacuum. The mixture is sonicated at precise vibrational frequencies to control the physical properties of the final blended content. A piston-like device is used to remove the blended content from the mixing chamber.

21 Claims, 2 Drawing Sheets

AUTOMATED BONE CEMENT MIXER

This application is a division of application Ser. No. 11/513,713 filed Aug. 31, 2006, now U.S. Pat. No. 8,057,090 which claims the benefit of U.S. Provisional Application No. 60/712,422 filed Aug. 31, 2005, which are hereby incorporated by reference in their entirety as if fully set forth herein.

FIELD OF THE INVENTION

A device for and method of mixing and blending by adding one or more sources to a mixing chamber and sonicating the contents.

BACKGROUND OF THE INVENTION

Bone cement has been used in the treatment of skeletal fractures, repair of skeletal and dental cavities, and fixation of total joint replacement and other implants for over fifty years. Currently, there are a variety of bone cement products, such as, polymethylacrylate or PMMA.

There are also a variety of mixing devices for the bone cement products. Many surgeons mix cement by hand in a bowl using a spatula. However, open hand mixing entraps air bubbles. The trapped air bubbles make the cement porous and adversely affect the mechanical properties of the cement. In recent years, vacuum mixing devices have been introduced where the mixing is performed in a closed container under vacuum to reduce porosity in the bone cement. However, the actual mixing is still conducted manually. The manual mixing creates non-uniform mixing and inconsistent quality of the final product. Furthermore, mechanical stirring devices may involve manual handling in removing the stirrer. This exposes the bone cement product to non-sterile surroundings and may introduce harmful materials into the product.

Other methods for mixing bone cement products include mixing the cement by releasing two components, a liquid and a powder, such that the two components merge into each other through divided vacuum packed plastic bags. Final mixing takes place by manipulating the flexible bags. Still other devices strike a container while the liquid and powder components are brought together under a vacuum. A removable stirrer is used.

None of these devices or methods provides uniformly consistent results that can be automated or controlled. None of these devices or methods provides predictable and optimal results independent of the variability of the user.

Needs exist for new devices for mixing bone cement and methods for mixing that improve consistency between users and optimize the mechanical characteristics of the bone cement.

SUMMARY OF THE INVENTION

The present invention is a novel mixing device and method that automates the process of mixing a powdered polymer and a liquid monomer in a consistent manner independent of individual user handling. The present invention may be used for any multiple component systems that require mixing.

One embodiment of the present invention uses sonication of a mixture of powder and liquid. A mixing chamber holds a liquid component of a mixture, while a flexible compartment holds a powdered component of the mixture. The mixing chamber and flexible compartment are separated by a divider. The divider is removed to mix the powder and liquid components. The combined powder and liquid components are sonicated until a desired mixture is created. The mixing chamber may then be inverted so that the blended product may flow freely by gravity or be forced by means of a piston like device into a flexible compartment to be squeezed out manually through an opening in the flexible compartment for use. Various attachments may be connected to an exit opening on the mixing chamber depending on the application. A power source, ultrasonic or vibrating transducer, and control system, monitor and control the mixing process.

One embodiment of the present invention combines vacuum and vibration mixing with vibration frequencies optimized to create desired porosity, mechanical properties, biocompatibility, durability, viscosity, timing prior to application, and aesthetics when, for example, dentistry is involved. The high level of control allows for predetermined degrees of viscosity or porosity to suit a variety of circumstances. Furthermore, risk of infection is reduced by minimizing direct handling as well as exposure to the environment of the components and final product prior to application. The present invention is applicable to medical, orthopedic and dental application as well as other industrial or culinary applications.

The present invention is also a method of mixing using the device of the present invention. Liquid and powder components are mixed together uniformly and conveniently with minimal human technique and interaction. The liquid and powder components of bone cement, or another mixture system, can be brought together in incremental proportionate amounts from separate chambers into a blending chamber in communication with a syringe-like dispensing and mixing unit. The application of a vacuum on the system pulls the liquid and powder components from the separate chambers into the blending chamber in proportionate amounts. Sonication is applied to the system to agitate the components in the blending chamber to facilitate the blending of components without stirring. A separate stirring device that would require removal may not be needed.

The resulting blend continues to mix as the blend is drawn up into the syringe-like dispensing and mixing unit. The mixture continues sonication and vacuum mixing until a desired mixture is achieved. The syringe-like dispensing and mixing unit is free or is made free of associated parts to allow for immediate application of the mixed cement directly from the syringe-like dispensing and mixing unit without the need to transfer cement, remove stirring blades or other elements from the core of the mixed cement. In addition to causing the blending of the liquid and powder components, the applied vacuum and sonication remove bubbles that create detrimental porosity in the mixed cement.

In general, vibration mixing reduces porosity and enhances the properties of bone cement. Vibration at optimal frequencies are preset and automated with minimal user handling of the materials.

These and further and other objects and features of the invention are apparent in the disclosure, which includes the above and ongoing written specification, with the drawings.

DETAILED DESCRIPTION OF THE PREFERRED EMBODIMENTS

Figure 1:
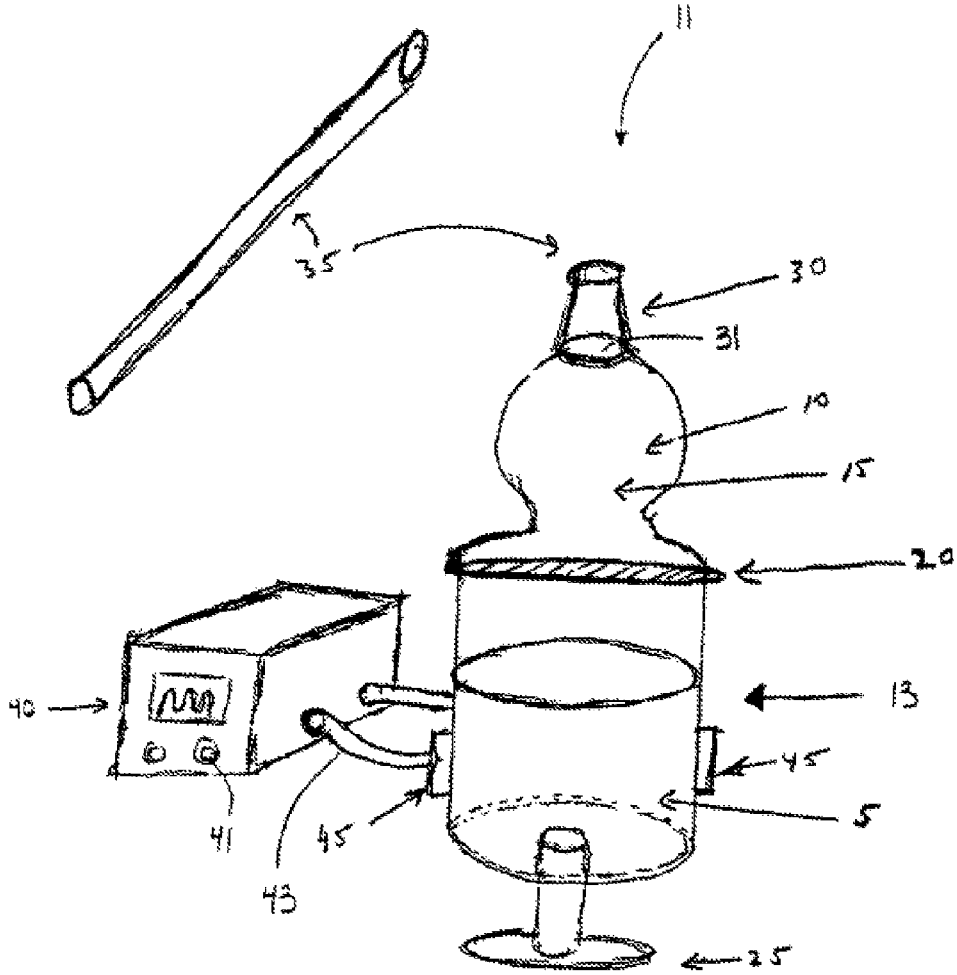
FIG. 1 is a schematic of an embodiment of a mixing device.

FIG. 1 is a schematic of an embodiment of a mixing device 11. A mixing chamber 13 is vacuum sealed and sterile. Liquid monomer 5 is prepackaged in the sealed sterile mixing chamber 13. A vacuum sealed flexible compartment 10 is located above and in communication with the mixing chamber 13. The flexible compartment 10 contains a prepackaged powdered polymer 15. A pinch device 20 separates the powdered polymer 15 in the flexible compartment 10 from the liquid monomer 5 in the mixing chamber 13. Alternatively the liquid monomer may be stored in a sealed glass or other suitable material that forms an ampoule with a narrow region that is broken to allow the monomer to flow to the mixing chamber.

The powdered polymer 15 is released from the flexible compartment 10 into the mixing chamber 13, which contains the liquid monomer 5. To release the powdered polymer 15, the pinch device 20 is removed. The releasing process may be performed manually or may be controlled electronically with sensors and actuators, not shown, connected to the pinch device 20. In a preferred embodiment, the powdered polymer 15 is released into the liquid monomer 5, however, in alternative embodiment, the liquid monomer 5 may be released into the powdered polymer 15.

After releasing the powdered polymer 15 into the mixing chamber 13 containing the liquid monomer 5, mixing is performed by sonicating the components in the mixing chamber 13.

Power is supplied to the mixing device 11 by a power source 40 with electrical controls 41 and connections 43. The electrical controls 41 monitor and control timing, sonication frequencies, vacuum, temperature, viscosity and other pertinent variables. Sonication is accomplished through the use of piezoelectric ceramics, other ultrasonic ceramic devices, or other similar devices 45.

Mixing continues until the blended content achieves a desired consistency or optimal physical characteristics. After mixing is complete the mixing 13 and flexible 10 compartments are inverted as a unit to allow the blended contents to flow from the mixing chamber 13 to the flexible compartment 10. The finished blended content is then released by gravity or by force through an opening 31 in the flexible compartment 10. A piston device 25 forces the mixed contents, which do not flow out on their own by gravity when the unit is inverted, out of the mixing chamber 13 and into the flexible compartment 10. In an alternative version the mixing chamber 13 is flexible as well as the flexible compartment 10 allowing for manual squeezing of the entire device, eliminating the need for the piston like device 25.

The mixed contents are then forced out of the opening 31 for use. A dispensing attachment 30 is connected to the flexible compartment 10 opposite the mixing chamber 13. Other additional attachments 35 may be connected to the dispensing attachment 30 or the dispensing attachment 30 may be used individually. Additional attachments 35 include, but are not limited to, long cylindrical tubes used for application of bone cement into a medullary cavity for hip replacements.

Figure 2:
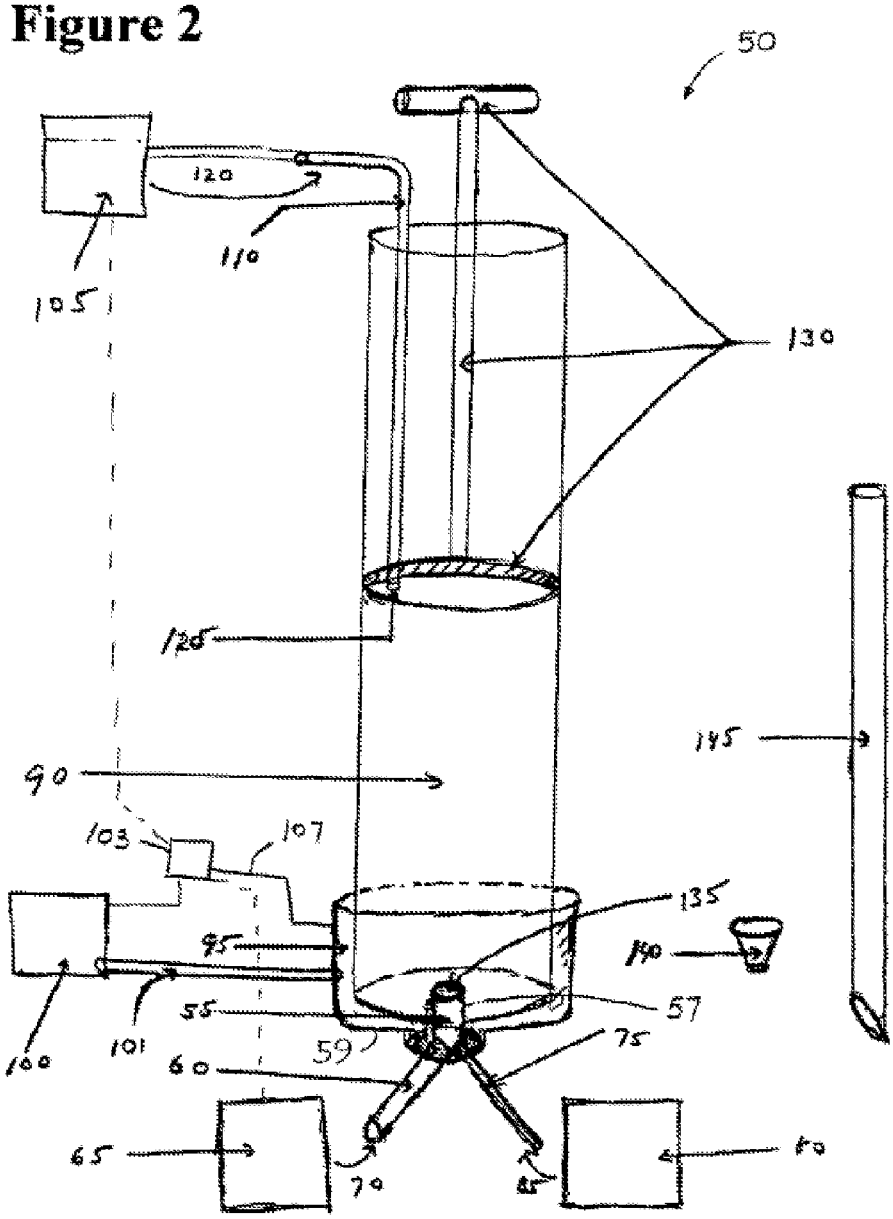
FIG. 2 is a schematic of an alternative embodiment of a mixing device.

FIG. 2 is a schematic of an alternative embodiment of a mixing device 50. Powdered polymer is moved 70 from a powdered polymer source 65 to a powdered polymer passage 60 near the base of the mixing device 50. Liquid monomer is moved 85 from a liquid monomer source 80 to a liquid monomer passage 75 near the base of the mixing device 50. Small amounts of liquid monomer and powdered polymer are brought together and sonicated at a blending area 55 at ends of the powdered polymer passage 60 and liquid monomer passage 75. The blending area 55 is preferably, but not limited to, a Y-shaped device or tube. The arms of the Y-shaped device 55 extend downward away from the base of the mixing device 50 and are both the powdered polymer passage 60 and liquid monomer passage 75 or opposite arms of the Y-shaped device 55 are connected to the powdered polymer passage 60 and liquid monomer passage 75. A stem section 57 of the blending area 55 passes through a base 59 of the mixing device 50. An opening 135 on the top of the stem section 57 opens into a mixing chamber 90.

The mixing and dispensing chamber 90 receives the blended contents from the blending area 55. Vacuum suction draws the powdered polymer from the powdered polymer source 65 through the powdered polymer passage 60 and liquid monomer from the liquid monomer source 80 through the liquid monomer passage 75. Both the powdered polymer and liquid monomer are then drawn into the blending area 55. The vacuum suction then draws the blended contents into the mixing and dispensing chamber 90. The blended contents experience continued mixing until the blended contents are ready to use.

A sonicator 95 is in contact with the blending area 55 and mixing chamber 90. The sonicator 95 is powered by a power source 100 connected 101 to the sonicator 95. Sonication occurs in the blending region 55 and in the mixing chamber 90. A control device 103 may be connected 107 to the sonicator 95 for sensing and automation.

A vacuum pump 105 is connected 120 to the mixing chamber 90 by tubing or a tube-like device 110. The tubing or tube-like device has an opening 125 on the end furthest from the vacuum pump 105, which allows vacuum pumping of the mixing chamber 90 and the connected powdered polymer source 65 and liquid monomer source 80. The blended contents are held in the mixing chamber 90, under vacuum, until the blended contents are ready for release and use.

To release the blended contents from the mixing chamber 90, a piston-like device 130 is used to push the blended contents out of the mixing chamber 90. The blended contents are released through the opening 135 in the blending region 55. The powdered polymer passage 60 and liquid monomer passage 75 may be removed prior to release. Attachments 140, 145 may be connected to the opening 135 before releasing the blended contents. The attachments 140, 145 facilitate specific uses of the final product. A conical attachment 140 or a long cylindrical attachment 145 may be used. The long cylindrical attachment 145 may be used to facilitate dispensing bone cement into a medullary cavity in hip replacements.

The present invention is not limited to uses for bone cement or related products. Other uses in other fields are anticipated for the device and process of the present invention. The device and process of the present invention may be used for creating mixtures of many different liquid and powdered materials.

An electronic component controls one or more of the mixing parameters such as the amplitude, frequency and duration of vibration and/or sonication, duration of overall mixing, and durations and timing of mixing steps as well as the rate of flow of the components to be mixed and degree and duration of vacuum application, and other atmospheric conditions such as temperature. This produces a repeatable and consistent quality of the product and minimizes manual handling of the mixing system.

While the invention has been described with reference to specific embodiments, modifications and variations of the invention may be constructed without departing from the scope of the invention.

The invention claimed is:

1. An apparatus for mixing cement products comprising: a mixing chamber, a power source, and a device to sonicate the mixing chamber, wherein the device to sonicate the mixing chamber is an ultrasonic or vibrating transducer, a control system and monitor, and one or more flexible compartments in communication with the mixing chamber but separated by a divider.

2. The apparatus of claim 1, wherein removing a flexible compartments' divider allows its contents to be blended in the mixing chamber.

3. The apparatus of claim 2, further comprising a piston to drive the blended contents out of the mixing chamber.

4. The apparatus of claim 2, wherein the mixing chamber is flexible, allowing the blended contents to be squeezed out of the chamber.

5. The apparatus of claim 2, wherein one or more flexible compartments has an opening allowing the blended contents to be squeezed out of the chamber through a flexible compartment.

6. The apparatus of claim 1, further comprising a blending area in communication with the mixing chamber and connected to one more source containers.

7. The apparatus of claim 6, further comprising a vacuum to draw the sources to be mixed out of the source containers, through the blending area and into the mixing chamber.

8. The apparatus of claim 7, further comprising a piston-like device to push the blended contents out of the mixing chamber.

9. The apparatus of claim 8, further comprising an opening in the blending area to release the blended contents.

10. The apparatus of claim 9, further comprising one or more attachments connected to the opening in the blended area to facilitate specific use of the blended contents.

11. The apparatus of claim 10, wherein the attachment is a conical attachment or a long cylindrical attachment.

12. A method of blending one or more sources using the apparatus of claim 1, comprising: first adding one or more sources to the mixing chamber, then sonicating the contents of the mixing chamber.

13. The method of claim 12, further comprising sonicating the contents by means of the ultrasonic or vibrating transducer.

14. The method of claim 13, further comprising storing the one or more sources in the flexible compartments attached to, but divided from, the blending chamber and removing the divider to add the sources to the mixing chamber.

15. The method of claim 14, further comprising using a piston to drive the blended contents out of the mixing chamber.

16. The method of claim 14, further comprising squeezing the blended contents out of the mixing chamber through an opening in one or more of the flexible chambers.

17. The method of claim 13, further comprising using a vacuum to draw one or more sources into the mixing chamber through a blending area.

18. The method of claim 17, further comprising using a piston-like device is used to push the blended contents out of the mixing chamber.

19. The method of claim 18, further comprising pushing the blended through an opening in the blending area.

20. The method of claim 19, further comprising connecting attachments to the opening in the blending area prior to pushing the blended contents out of that opening.

21. The method of claim 20, wherein the attachments are shaped in a conical or long cylindrical manner.

* * * * *